US011946178B2

(12) United States Patent
Bodin et al.

(10) Patent No.: US 11,946,178 B2
(45) Date of Patent: Apr. 2, 2024

(54) PACKAGING MATERIAL AND AN ORAL POUCHED SNUFF PRODUCT

(71) Applicant: Swedish Match North Europe AB, Stockholm (SE)

(72) Inventors: Cristian Bodin, Lerum (SE); Linnea Seiler, Partille (SE)

(73) Assignee: SWEDISH MATCH NORTH EUROPE AB, Stockholm (SE)

( * ) Notice: Subject to any disclaimer, the term of this patent is extended or adjusted under 35 U.S.C. 154(b) by 130 days.

(21) Appl. No.: 17/431,581

(22) PCT Filed: Feb. 17, 2020

(86) PCT No.: PCT/EP2020/054053
§ 371 (c)(1),
(2) Date: Aug. 17, 2021

(87) PCT Pub. No.: WO2020/169514
PCT Pub. Date: Aug. 27, 2020

(65) Prior Publication Data

US 2022/0112638 A1 Apr. 14, 2022

(30) Foreign Application Priority Data

Feb. 19, 2019 (SE) ..... 1950207-9

(51) Int. Cl.
*D04H 1/4382* (2012.01)
*A24B 13/00* (2006.01)
(Continued)

(52) U.S. Cl.
CPC ..... *D04H 1/43828* (2020.05); *A24B 13/00* (2013.01); *B65D 65/463* (2013.01);
(Continued)

(58) Field of Classification Search
CPC .. D04H 1/43828; D04H 1/425; D04H 1/5412; A24B 13/00; B65D 65/463;
(Continued)

(56) References Cited

U.S. PATENT DOCUMENTS 6,383,431 B1 5/2002 Dobrin et al.
2011/0165470 A1 7/2011 Dahringer et al.
(Continued)

FOREIGN PATENT DOCUMENTS

EP 2778271 9/2014
WO WO 2001/049912 7/2001
(Continued)

OTHER PUBLICATIONS

International Search Report and Written Opinion dated May 18, 2020 by the International Searching Authority for International Application No. PCT/EP2020/054053, filed on Feb. 17, 2020 and published as WO 2020/169514 dated Aug. 27, 2020 (Applicant—Swedish Match North Europe AB) (10 Pages).
(Continued)

*Primary Examiner* — Jeremy R Pierce
(74) *Attorney, Agent, or Firm* — Ballard Spahr LLP

(57) ABSTRACT

The present invention relates to a packaging material for use in an oral pouched snuff product in order to enclose a smokeless tobacco composition or non-tobacco composi¬tion. The packaging material is a saliva-permeable nonwoven comprising carded fibres, whereof 0%-95% of the carded fibres are of a first type and 5%-100% are of a second type. The fibres of the first type are cellulose-based staple fibres. The fibres of the second type are thermoplastic fibres, comprising a first component and a second component, the second component having a lower melting temperature than the first component. The packaging material is bonded by means of at least partial melting and/or softening
(Continued)

of the second component of the fibres of the second type and has a smooth-calendered surface.
The present invention also relates to an oral pouched snuff product comprising such a packaging material.

23 Claims, 1 Drawing Sheet

(51) Int. Cl.
*B65D 65/46* (2006.01)
*D04H 1/425* (2012.01)
*D04H 1/541* (2012.01)

(52) U.S. Cl.
CPC ..... *D04H 1/425* (2013.01); *D04H 1/5412* (2020.05); *D10B 2201/01* (2013.01); *D10B 2321/021* (2013.01); *D10B 2321/022* (2013.01); *D10B 2331/041* (2013.01)

(58) Field of Classification Search
CPC ..... D10B 2321/022; D10B 2201/01; D10B 2331/041; D10B 2321/021; D10B 2321/041
See application file for complete search history.

(56) References Cited

U.S. PATENT DOCUMENTS

| | | | | |
|---|---|---|---|---|
| 2011/0303511 | A1 | 12/2011 | Brinkley et al. | |
| 2012/0031416 | A1 | 2/2012 | Atchley et al. | |
| 2012/0051672 | A1 | 3/2012 | Foss et al. | |
| 2012/0103353 | A1 | 5/2012 | Sebastian et al. | |
| 2015/0128978 | A1* | 5/2015 | Sebastian | B65D 51/20 427/323 |
| 2015/0189910 | A1 | 7/2015 | Sebastian et al. | |
| 2016/0073689 | A1 | 3/2016 | Sebastian et al. | |
| 2016/0264346 | A1 | 9/2016 | Foss et al. | |
| 2017/0281425 | A1 | 10/2017 | Herfert et al. | |
| 2018/0255826 | A1* | 9/2018 | Persson | B29C 66/4322 |

FOREIGN PATENT DOCUMENTS

| | | |
|---|---|---|
| WO | WO 2012/061192 | 5/2012 |
| WO | WO 2016/040754 | 3/2016 |
| WO | WO 2017/093488 | 6/2017 |

OTHER PUBLICATIONS

International Preliminary Report on Patentability dated Feb. 17, 2021 by the International Searching Authority for International Application No. PCT/EP2020/054053, filed on Feb. 17, 2020 and published as WO 2020/169514 dated Aug. 27, 2020 (Applicant—Swedish Match North Europe AB) (19 Pages).
NPT Nonwovens Corporation, "What is through air bonding" [online], Posted Jun. 5, 2018, [retrieved on Jan. 31, 2022], URL: https://www.wptnonwovens.com/blog/blog-what-is-through-airbonding.

* cited by examiner

PACKAGING MATERIAL AND AN ORAL POUCHED SNUFF PRODUCT

CROSS-REFERENCE TO RELATED APPLICATIONS

This application is a U.S. National Phase Application of International Application No. PCT/EP2020/054053, filed Feb. 17, 2020, which claims priority to Swedish Application No. 1950207-9, filed Feb. 19, 2019, each of which are hereby incorporated by reference in their entirety.

TECHNICAL FIELD

The present invention relates to a packaging material for use in an oral pouched snuff product and to an oral pouched snuff product.

BACKGROUND

Smokeless tobacco products for oral use are made from tobacco leaves, such as lamina and stem of the tobacco leaf. The material from roots and stalks are normally not utilized for production of smokeless tobacco compositions for oral use.

Smokeless tobacco for oral use includes chewing tobacco, dry snuff and moist (wet) snuff. Generally, dry snuff has moisture content of less than 10 wt % and moist snuff has a moisture content of above 40 wt %. Semi-dry products having between 10% to 40 wt % moisture content are also available.

There are two types of moist snuff, the American type and the Scandinavian type. The Scandinavian type of moist snuff is also called snus. American-type moist snuff is commonly produced through a fermentation process of moisturized ground or cut tobacco. Scandinavian-type moist snuff (snus) is commonly produced by using a heat-treatment process (pasteurization) instead of fermentation. Both processes reduce the bitterness of unprocessed tobacco and also soften the texture of the tobacco being the primary reasons why not unprocessed tobacco is used for the production of moist snuff. The heat-treatment is also carried out in order to degrade, destroy or denature at least a portion of the microorganisms within the tobacco preparation.

Both the American-type and the Scandinavian-type of moist snuff for oral use are available in loose form or portion-packed in a saliva-permeable, porous wrapper material forming a pouch. Pouched moist snuff, including snus, is typically used by the consumer by placing the pouch between the upper or lower gum and the lip and retaining it there for a limited period of time. The pouch material holds the tobacco in place while allowing saliva to pass into the tobacco and allowing flavours and nicotine to diffuse from the tobacco material into the consumer's mouth.

The pouch material used in oral pouched snuff products, also called the packaging material, is a saliva-permeable nonwoven. Nonwovens are fabrics that are neither woven nor knitted.

A carded web is an example of a dry-laid nonwoven. If carded, the manufacturing process may result in fibres substantially being oriented in the carding direction. Dry-laid nonwoven may comprise parallel laid web, cross laid webs or randomly laid webs. Parallel laid webs and cross laid webs normally include two or more superimposed web layers, which normally are carded, while randomly laid webs normally include a single web layer, which may be airlaid.

According to known technology, several different methods may be used to bond together the fibres in the web, also called web consolidation. The different types of bonding methods may be classified as mechanical bonding, e.g. needle punching, stitch bonding, hydro-entanglement, as chemical bonding, e.g. saturation bonding, spray bonding, foam bonding, powder bonding, print bonding and as thermal bonding, e.g. point-bonding in a hot calendar. More than one bonding method may be used to consolidate the nonwoven. In chemical bonding, a binder, also called bonding agent or adhesive, is combined with the fibres. This type of nonwoven is generally called chemically bonded or adhesive bonded nonwoven.

Pouched smokeless tobacco products for oral use may be post-moisturized after pouch formation or not post-moisturized after pouch formation. Pouched smokeless tobacco products for oral use which are not post-moisturized is herein referred to as non-post-moisturized. Post-moisturized pouched products may be produced by spraying water on the pouched smokeless tobacco product before packaging the pouched products in cans. The moisture content of the final oral pouched smokeless tobacco product comprising moist or semi-dry snuff is normally within the range of from 25 to 55% w/w based on the weight of the pouched product (i.e. the total weight of moist snuff and pouch material).

There are also smokeless non-tobacco products for oral use, which do not contain any tobacco material. Instead, the oral smokeless non-tobacco product comprises non-tobacco plant material and/or a filling material.

Addition of a small amount of tobacco to the oral smokeless non-tobacco product provides an oral smokeless low tobacco snuff product. Thus, in addition to a small amount of tobacco the oral smokeless snuff product comprises non-tobacco plant material as described herein and/or a filling material as described herein.

Examples of nicotine-free moist non-tobacco snuff products for oral use and the manufacture thereof are provided in WO 2007/126361 and WO 2008/133563. This type of non-tobacco snuff product for oral use may be provided in loose form or portion-packed in a saliva-permeable, porous wrapper material forming a pouch.

For nicotine-containing oral smokeless non-tobacco products, or oral smokeless low tobacco snuff products which contain nicotine in addition to the nicotine provided by the tobacco in said product, the nicotine may be synthetic nicotine and/or nicotine extract from tobacco plants. Further, the nicotine may be present in the form of nicotine base and/or a nicotine salt.

The oral smokeless non-tobacco product or the oral smokeless low tobacco snuff product may be dry, semi-dry or moist. Generally, dry oral smokeless non-tobacco products or dry oral smokeless low tobacco snuff products have a moisture content of less than 10 wt % and moist oral smokeless non-tobacco products or moist oral smokeless low tobacco snuff products have a moisture content of above 40 wt %. Semi-dry oral smokeless non-tobacco products or semi-dry oral smokeless low tobacco snuff products have a moisture content between 10 wt % and 40 wt %.

The oral smokeless non-tobacco products or oral smokeless low tobacco snuff product may be flavourized by mixing the flavour with the oral smokeless non-tobacco product components or the oral smokeless snuff product components during manufacturing. Additionally or alternatively, the flavour may be added to the oral smokeless non-tobacco product or oral smokeless snuff product after it has been manufactured.

Pouched smokeless tobacco products may be produced by measuring portions of the smokeless tobacco composition and inserting the portions into a nonwoven tube.

U.S. Pat. No. 4,703,765 discloses a device for packaging precise amounts of finely divided tobacco products, such as snuff tobacco or the like, in a tubular packaging material into which snuff portions are injected via a fill tube. Downstream from the tube, welding means are positioned for transverse sealing of the packaging material, and also cutting means for severing the packaging material in the area of the transverse seal to thus form discrete or individual portion packages.

Pouched smokeless tobacco products may alternatively be produced by placing portions of moist snuff on a nonwoven web using a pouch packer machine in accordance with the device disclosed in U.S. Pat. No. 6,135,120.

The individual portions are sealed and cut apart thereby forming rectangular "pillow shaped" (or any other desired form) pouched products. Generally, each final pouched product includes parallel transverse seals at opposite ends and a longitudinal seal orthogonal to the transverse seals. The seals must be of sufficient strength to preserve the integrity of the pouched product during use while not disturbing the consumer's experience.

Oral pouched smokeless tobacco products are normally sized and configured to fit comfortably and discreetly in a user's mouth between the upper and lower gum and the lip.

For a packaging material for an oral pouched snuff product, there is typically a trade-off between strength and comfort when placed in the buccal cavity of the user. The packaging material forms the outside of the pouched product and is hence in contact with the buccal cavity, typically between the teeth and gum. The strength of the packaging material should desirably be high enough to handle the packaging material during manufacturing of the packaging material itself, during manufacturing of the pouched product and for the pouched product in use in the buccal cavity. Thereby, it is important that the seals of the pouched product are strong enough. Yet the packaging material should desirably be flexible enough to be comfortable when the oral pouched snuff product is placed in the buccal cavity of the user. Commonly used packaging material may often suffer from having a seal strength of the pouched product being less than desirable, especially when exposed to aggressive flavours comprised in the smokeless tobacco composition or non-tobacco composition enclosed by the packaging material in the pouched product.

It may further be desirable that the oral pouched snuff product is experienced as soft in the mouth. Moreover, it may be desirable that the packaging material is experienced as less slippery in the mouth as compared to commonly used packaging materials for oral pouched snuff products.

The object of the present invention is to overcome or at least mitigate some of the problems associated with the prior art.

Definitions

By "tobacco" is meant any part, e.g. leaves, stems, and stalks, of any member of the genus *Nicotiana*. The tobacco may be whole, shredded, threshed, cut, ground, cured, aged, fermented, or treated in any other way, e.g. granulated or encapsulated.

The term "tobacco snuff composition" is used herein for a finely divided tobacco material such as a ground tobacco material or cut tobacco. In addition to the tobacco material, the tobacco snuff composition may further comprise at least one of the following: water, salt (e.g. sodium chloride, potassium chloride, magnesium chloride, calcium chloride and any combinations thereof), pH adjuster, flavouring agent, cooling agent, heating agent, sweetening agent, colorant, humectant (e.g. propylene glycol or glycerol), antioxidant, preservative (e.g. potassium sorbate), binder, disintegration aid. In an example, the smokeless snuff composition comprises or consists of finely divided tobacco material, salt such as sodium chloride, and a pH adjuster. The tobacco snuff composition may be dry or moist. The tobacco snuff composition may be used between the teeth and gum.

A "non-tobacco composition" is a composition which does not contain any tobacco material, and which may be used in a similar way or in the same way as a tobacco snuff composition. Instead of tobacco, the non-tobacco composition may contain non-tobacco plant fibres and/or a filling material. Also processed fibres such as Microcrystalline Cellulose fibres may be used. The filling material may be present in the form of particles. For instance, the filling material may be a particulate filling material such as particles of microcrystalline cellulose. The non-tobacco composition may contain nicotine, i.e. it may be a nicotine-containing non-tobacco composition. Alternatively, the non-tobacco composition may contain no nicotine or substantially no nicotine, i.e. it may be a nicotine-free non-tobacco composition. As used herein, the expression "substantially no nicotine" intends an amount of nicotine of 1 percent by weight or less based on the total dry weight of the composition.

"Oral" and "oral use" is in all contexts used herein as a description for use in the oral cavity, such as buccal placement. The product is then intended for placement within the oral cavity, such as between the gum and the upper or lower lip, such that the product as a whole is contained in the oral cavity. The product is not intended to be swallowed.

As used herein "pouched product" or "oral pouched product" refers to a portion of smokeless tobacco composition or non-tobacco composition packed in a saliva-permeable pouch material intended for oral use, such as by buccal placement in the oral cavity. The oral pouched product may alternatively be referred to as a portion-packed (pouched) product for oral use.

As used herein, the term "moisture content" refers to the total amount of volatile ingredients, such as water and other oven volatiles, e.g. propylene glycol and ethanol, in the composition or product referred to. The moisture content is given herein as percent by weight (wt %), i.e. weight percent of the component referred to based on the weight of the total composition, preparation or product referred to.

"Flavour" or "flavouring agent" is used herein for a substance used to influence the aroma and/or taste of the smokeless tobacco product, including, but not limited to, essential oils, single flavour compounds, compounded flavourings, and extracts.

SUMMARY

The object of the present disclosure is to overcome or ameliorate at least one of the disadvantages of the prior art, or to provide a useful alternative.

The object above may be achieved by the subject-matter of claim 1 and/or claim 21. Embodiments are set forth in the appended dependent claims and in the description.

The present invention relates to a packaging material for use in an oral pouched snuff product in order to enclose a smokeless tobacco composition or non-tobacco composition. The packaging material is a saliva-permeable nonwoven comprising carded fibres, whereof 0%-95% of said carded fibres are of a first type and 5%-100% of said carded fibres are of a second type, with % numbers determined as % of total fibre weight at 21° C. and 50% RH. The fibres of the first type are cellulose-based staple fibres. The fibres of the second type are thermoplastic fibres comprising a first component and a second component, the second component having a lower melting temperature than the first component. The packaging material is bonded by means of at least partial melting and/or softening of the second component of the fibres of the second type.

The fibres of the second type comprise at least two components in the same fibre, but it would also be feasible to have three or more different components. Further, at least one of the components of the fibres of the second type may be a mixture of different polymers. The fibres of the second type may be bi-component fibres, i.e. consisting of the first component and the second component mentioned above. In that case, the bi-component fibres preferably are sheath-core fibres, but other arrangements such as "side-by-side" or "islands-in-the-sea" arrangements would also be feasible.

As is further described herein, air-through bonding may be utilized during manufacturing of the packaging material to obtain the at least partial melting and/or softening of the second component of the fibres of second type.

The at least partially melted and/or softened second component of the fibres of the second type bind the fibres of the packaging material together to form a cohesive web. In the bonded web of the packaging material, the fibres still maintain their shape and structure. There is hence no film formed in the packaging material, which would have been the expected result if the fibres of the second type had melted more or less completely. The degree of desired melting is a balance between tensile strength, which increases with the degree of melting, and the appearance and function of the oral pouched snuff product in the buccal cavity, wherein a too melted packaging material may function less well for the oral pouched snuff product, since e.g. a film would be too dense and/or not sufficiently saliva permeable.

By utilizing the fibres of the second type with at least partial melting and/or softening of the second component, there is no need to have an additional binder in the packaging material, which is the case for commonly used packaging materials for oral pouched snuff products. Neither is the packaging material according to the invention bonded by hydroentangling or point-bonding as is common in prior art. Not to be bound by any theory, it is believed that when the packaging material according to the invention is subjected to a pulling force, the fibres hook on to each other due to the at least partial melting or softening and thereby become at least partly stuck to each other, such that forces can be transferred from one fibre to an adjacent or crossing fibre. Accordingly, the packaging material is sufficiently strong without an additional binder.

The fibres of the first type may be selected to give the packaging material desired mechanical properties, such that the packaging material is easy to handle during manufacturing of the packaging material itself and/or during manufacturing of the oral pouched snuff product and yet is comfortable when the oral pouched snuff product is placed in the buccal cavity of the user, the packaging material then forming the outside of the product. Accordingly, the fibres of the first type may be selected to be soft, relatively inelastic and/or moisture absorbent. The relative inelasticity makes the packaging material easy to handle during manufacturing of the packaging material itself and/or during manufacturing of the oral pouched snuff product and the softness and moisture absorbency provide comfort in the buccal cavity of the user. Further, the fibres of the first type may be selected to be hydrophilic, which is advantageous when used for an oral pouched snuff product.

The fibres of the second type may be selected to have a second component, such that the fibres of the second type are able to melt and/or soften at least at the surface. The fibres of the second type may be selected to have a pre-selectable level of strength, a pre-selectable linear density and/or a pre-selectable shape, e.g. trilobal. Further, the fibres of the second type may as an option be crimped. The fibres of the second type may thus be selected to give the packaging material a desired level of tensile strength and/or seal strength. In particular, the fibres of the second type make it possible to obtain a high seal strength, also in wet conditions.

By utilizing a packing material as described herein, it is possible to manufacture an oral pouched snuff product having appropriate strength both for the material and the seals and which yet is flexible enough to be comfortable when the oral pouched snuff product is placed in the buccal cavity of the user.

The oral pouched snuff product comprising the packaging material as described herein may be experienced as softer in the mouth as compared to oral pouched snuff products with prior art packaging material. Not to be bound by any theory, this is believed to be a result of the absence of a binder, which is commonly used in prior art packaging materials for oral pouched snuff products.

Commonly used packaging materials may often suffer from having a seal strength of the pouched product being less than desirable. Some flavours, comprised in the smokeless tobacco composition or non-tobacco composition material enclosed by the packaging material in the pouched product, are known to be able to have a potentially negative impact on the seal strength, especially over time, for conventional pouched snuff products, which may lead to seal rupture upon storage of the products. In particular, impaired seal strength is a problem for moist oral pouched products. The strength of the packaging material as described herein and the strength of the seals may be adapted to resist such flavours better than commonly used packaging materials for oral pouched snuff products.

Further, the packaging material according to the invention may be experienced as less slippery in the mouth as compared to commonly used packaging materials for oral pouched snuff products. Not to be bound by any theory, also this is believed to be a result of the absence of a binder, which is commonly used in prior art packaging materials for oral pouched snuff products.

If the oral pouched snuff product is post-moisturized, an oral pouched snuff product with the packaging material as described herein may have a more even colour as compared to commonly used packaging materials for oral pouched snuff products. Also this is believed to be a result of the absence of a binder, which commonly is hydrophobic. In particular, this effect may be achieved if the fibres of the second type are PLA/coPLA fibres, e.g. with PLA in the core and coPLA in the sheath, as disclosed in further detail elsewhere herein.

As mentioned above, the fibres of the packaging material are carded. The carding unit may comprise one or more scrambler rollers, which are utilized to make the packaging material less anisotropic.

Of all the fibres of the packaging material, the fibres of the first type typically may make up 5%-50% of the total weight, preferably 10%-40% of the total weight or 15%-30% of the total weight. The weights are defined at 21° C. and 50% RH.

It is also feasible to use 0% of the fibres of the first type, i.e. to completely dispense with the fibres of the first type.

Of all the fibres of the packaging material, the fibres of the second type typically may make up 50%-95% of the total weight, preferably 60%-90% of the total weight or 70-85% of the total weight. The weights are defined at 21° C. and 50% RH. It is also feasible to use up to 100% of the fibres of the second type, e.g. to only use fibres of the second type and none of the first type.

As mentioned above, it is preferred that the packaging material according to the invention does not comprise any binder or other kind of adhesive. The packaging material may consist of 0-95% of the fibres of the first type, 5%-100% of the fibres of the second type and, optionally, of one or more further thermoplastic fibre/s, e.g. a thermoplastic bi-component fibre. Hence, in an embodiment, the packaging material may consist of the fibres of the first type and the fibres of the second type, i.e. there is no other constituent added during manufacturing of the packaging material. If dispensing with the fibres of the first type, the packaging material according to the invention may consist of the fibres of the second type and, optionally, of one or more further thermoplastic fibre/s, e.g. thermoplastic bi-component fibres.

The packaging material has a smooth-calendered surface. A suitable method to achieve this is smooth calendering, which is utilized for surface treatment, e.g. by pressing together the packaging material, i.e. the calendering is not utilized for bonding. Hence the calendar rolls are not patterned, i.e. no patterning effect is applied by calendering. In particular, the packaging material is not point-bonded as is known from commonly used packaging materials for oral pouched snuff products. Without calendering, the packaging material according to the invention is very airy and fluffy. With calendering, the packaging material is made thinner and flatter, as compared to the packaging material before calendering.

The fibres of the first type, which may be dispensed with, may be natural cellulose fibres or a man-made cellulose-based fibres, e.g. regenerated cellulose fibres, such as rayon, lyocell or viscose. Tencel is a brand name for lyocell.

These fibres are known to be soft, relatively inelastic and/or moisture absorbent. Thereby the packaging material may be given desired mechanical properties, such that the packaging material is easy to handle during manufacturing of the packaging material itself and/or during manufacturing of the oral pouched snuff product and yet comfortable when the oral pouched snuff product is placed in the buccal cavity of the user. Further, these fibres are hydrophilic, which is advantageous when used for an oral pouched snuff product.

Man-made fibres are fibres whose chemical composition, structure, and properties are significantly modified during the manufacturing process. They are made of polymers. Man-made fibres are to be distinguished from natural fibres. Natural fibres also consist of polymers but they emerge from the manufacturing process in a relatively unaltered state.

Some man-made fibres are derived from naturally occurring polymers, e.g. rayon, lyocell or viscose, which are derived from cellulose fibres. However, the cellulose is acquired in a radically altered state as compared to the raw material source, e.g. wood, and is further modified in order to be regenerated into man-made cellulose-based fibres. Such fibres, e.g. the rayon, lyocell or viscose, are known as regenerated cellulose fibres.

Another group of man-made fibres, which is much larger, is synthetic fibres. Synthetic fibres are made of polymers that do not occur naturally but instead are produced entirely in e.g. a chemical plant or laboratory.

The fibres of the first type may have a length within the range of 30-80 mm, preferably within the range of 38-60 mm. The fibres of the first type may be produced as staple fibres having a standardized length. Commonly used lengths are 38, 40, 60 and 80 mm.

The fibres of the first type may have a linear density 3.3 dtex, preferably ≤1.7 dtex, more preferably ≤1.3 dtex, most preferably ≥0.9 dtex.

The fibres of the second type may have a length within the range of 30-80 mm, preferably within the range of 38-60 mm. The fibres of the second type may be produced as staple fibres having a standardized length. Commonly used lengths are 38, 40, 60 and 80 mm. The fibres of the second type may have the same or a different length as compared to the first type. When two or more fibres of the second type are used, they may have the same or different lengths.

The fibres of the second type may have a linear 4.4 dtex, preferably ≥2.2 dtex, more preferably ≥1.7 dtex, most preferably ≥1.3 dtex.

The first component of the fibres of the second type may have a melting point within the range of 140-180° C., preferably in the range of 150-170° C., more preferably within the range of 155-165° C. When air-through bonding is used for manufacturing the packaging material, the melting point may be selected such that the first component is not influenced by melting and/or softening in the air-through bonding.

The second component of the fibres of the second type may have a melting point within the range of 110-150° C., preferably within the range of 120-140° C., more preferably within the range of 125-135° C. Hence, the melting point may be selected to be below temperatures commonly used during air-through bonding, such that the fibres of the second type at least partly melts and/or softens during the manufacturing of the packaging material, e.g. during the air-through bonding.

Further, the melting points of both the first and the second component of the fibres of the second type may be selected such that at least the second component, preferably both components, are affected by melting during sealing of the oral pouched snuff product. This will help to provide a high, or at least sufficient, seal strength.

The fibres of the second type may be PLA/coPLA fibres, wherein the coPLA makes up a weight percentage of the fibres of the second type being within the range of 10%-90%, preferably within the range of 30%-70%, more preferably within the range of 40%-60%, most preferably within the range of 45%-55%. PLA stands for polylactic acid. The coPLA is a low-melt PLA. By utilizing PLA/coPLA fibres, the packaging material will be compostable. Compostability is described in the standard EN 13432, which comprises sections about biodegradability, see ISO 14855, and quantitative disintegration, see ISO 16929. For example, the fibres of the second type may be sheath/core bi-component fibres with PLA in the core and coPLA in the sheath. The weights are defined at 21° C. and 50% RH.

As an alternative or a complement, the fibres of the second type may be PP/PE fibres, wherein the PE makes up a weight percentage of the total weight of the fibres of the second type being within the range of 10%-90%, preferably within the range of 30%-70%, more preferably within the range of 40%-60%, most preferably within the range of 45%55%. PE stands for polyethylene and PP stands for polypropylene. The use of PP/PE gives a soft packaging material. For example, the fibres of the second type may be sheath/core bi-component fibres with PP in the core and PE in the sheath. The weights are defined at 21° C. and 50% RH.

As mentioned above, some flavours comprised in the smokeless tobacco composition or non-tobacco composition material enclosed by the packaging material in the pouched product are known to be able to have a potentially negative impact on the seal strength, especially over time, for conventional pouched snuff products, which may lead to seal rupture upon storage of the products. In particular, impaired seal strength is a problem for moist oral pouched products. It has been found that, if using PP/PE bi-component fibres as fibres of the second type, the strength of the packaging material and the strength of the seals will resist such flavours well, i.e. better than commonly used packaging materials for oral pouched snuff products.

The packaging material may have a bending stiffness in the machine direction within the range of 0.5-1.7 mNcm, preferably within the range of 0.6-1.4 mNcm, more preferably within the range of 0.7-1.1 mNcm, the bending stiffness being measured by the EDANA standard method WSP 090.5R4(12) A. The unit mNcm stands for milliNewtoncentimetres. Samples were conditioned for at least 4 hours in 21° C. and 50% RH, relative humidity.

The packaging material may have an air permeability ≤7500 $l/m^2/s$, preferably ≤4300 $l/m^2/s$, more preferably ≤2900 $l/m^2/s$, most preferably ≤2000 $l/m^2/s$, when measured according to the test method WSP070.1.R3(12) specified by EDANA, i.e. the European Disposables and Nonwovens Association.

The packaging material may have a ratio between wet tensile strength and dry tensile strength, both taken in the machine direction of said packaging material, being above 0.7, preferably above 0.8, more preferably above 0.9, most preferably above 1.0.

The packaging material may have a dry seal strength of at least 0.2 N/mm, preferably at least 0.25 N/mm, more preferably at least 0.3 N/mm, most preferably at least 0.4 N/mm, assuming said seal being made by ultrasonic welding. The dry seal strength values may be determined with the CORESTA method for seal strength as disclosed in further detail elsewhere herein. Further, the dry seal strength is preserved over time.

The packaging material may have a wet seal strength of at least 0.2 N/mm, preferably at least 0.25 N/mm, more preferably at least 0.3 N/mm, most preferably at least 0.4 N/mm, assuming said seal being made by ultrasonic welding. The wet seal strength values may be determined with the CORESTA method for seal strength as disclosed in further detail elsewhere herein. Further, the wet seal strength is preserved over time.

The packaging material may have a ratio between wet and dry seal strength being above 0.7, preferably above 0.8, more preferably above 0.9, most preferably above 1.0. The wet and dry seal strength values may be determined with the CORESTA method for seal strength as disclosed in further detail elsewhere herein. This is applicable both for seals made with ultrasonic welding and with heat sealing.

The packaging material may have a dry seal strength when exposed to methyl salicylate of at least 0.05 N/mm after 1 week at 4° C.+3 weeks at room temperature, preferably at least 0.1 N/mm. Seal strengths may be tested with the settings described in EP 3 192 380 A1, paragraph [0137].

The present invention also relates to an oral pouched snuff product comprising a portion of a smokeless tobacco composition or non-tobacco composition material and a saliva-permeable pouch. The pouch encloses the portion of the smokeless tobacco composition or non-tobacco composition material and comprises or consists of a packaging material as described herein. The packaging material is sealed with at least one seal to enclose the smokeless tobacco composition or non-tobacco composition. The seal is formed by means of at least the second component of the fibres of the second type being at least partially melted and/or softened in the seal, preferably both the first component and the second component of the fibres of the second type being at least partially melted and/or softened in the seal.

Thereby it is ascertained that the seal has an appropriate seal strength for a product to be used in the buccal cavity. The advantages described above for the packaging material are applicable for the oral pouched snuff product as well.

There are two main ways of sealing the packaging material: heat-sealing and ultrasonic welding, but the packaging material as described herein is advantageous for both. A suitable method and apparatus for ultrasonic welding is disclosed in WO 2017/093486 A1 relating to a sealing device for sealing a packaging material enclosing a portion of a smokeless tobacco composition or non-tobacco composition to provide portion-packed oral pouched snuff products. The document further relates to an arrangement for manufacturing of portion-packed oral pouched snuff products, which arrangement comprises such a sealing device. The document also relates to a method for portion-packing of an oral pouched snuff product.

The oral pouched snuff product according to the invention may have a height of at least 5.5 mm, preferably at least 6 mm, when measured optically, for products having a length of 28 mm, a width of 14 mm and a weight of 0.40 grams.

Methods

Bending Stiffness

Bending stiffness is measured by the EDANA standard method WSP 090.5R4(12) A. The unit mNcm stands for milliNewtoncentimetres. Samples were conditioned for at least 4 hours in 21° C. and 50% RH, relative humidity.

Tensile Strength

Tensile strength is measured by the EDANA standard method WSP110.4(05).

Seal Strength—General

Seal strength may be tested either in a dry state or a wet state of the sample. The samples may be taken from a production machine making oral pouched snuff products. Such products usually have one longitudinal seal, forming a tubular structure, and a transverse seal at either end of the product. Alternatively, the seals may be prepared in lab-scale. In that case, a strip of the material is folded and welded to itself, in the way described in EP 3 192 380 A1, paragraph [0136].

The seal strengths were then measured with the method described in EP 3 192 380 A1, paragraph [0137] or with the CORESTA method for seal strength described herein. For both methods, the first transverse seal made for the pouched product, i.e. the seal initially subjected to the smokeless tobacco composition or non-tobacco composition was measured.

Seal Strength—CORESTA Method

CORESTA is an abbreviation for Cooperation Centre for Scientific Research Relative to Tobacco. The CORESTA method for seal strength comprises:

1. Remove all material from the pouch and cut a sample to 10 mm±1 mm for the longitudinal seal sample and as close to the edges as possible for the transverse seal sample. Record widths on form for each transverse seal sample prepared as pouch format may vary. Prepared sample width shall be consistent. The first transverse seal made for the pouch, i.e. the seal initially subject to the smokeless tobacco composition or non-tobacco composition is the one to be measured.

2. Condition samples at 22° C.±1° C. and 60%±3% RH for 24 hours prior to testing (not necessary for wet measurements).

3. Jaw separation to be set at 15 mm±0.1 mm. Record separation on form.

4. Pull speed to be set at 20 mm/min and record speed on form.

5. Use a recommended pre-load of 0.1 N whenever possible.

6. Measure the average load if possible for transverse seal values (if not record the max load) and the maximum load for longitudinal seals. Record values on form.

7. For wet measurements: Dip sample in demineralized water for 60 minutes prior to testing the transverse or longitudinal seals. Record values on form.

Seal Strength—with Flavour

The tested flavour was methyl salicylate. The samples were made in a corresponding way as conventional pouched products using Merz technique with conventional heat sealing. In general, the smokeless tobacco composition or non-tobacco composition has a moisture content of 28-30% and the pouches are thereafter post-moisturized using a thin water beam to an end concentration of 48-51%. The temperatures used when making the longitudinal seal and the transverse seals are set with reference to each type of packaging material, e.g. considering its melting temperature. The speed of the machine is also adjusted to give the best possible seal strength.

In the tests referred to below, temperatures used when making the longitudinal seal and the transverse seals were set to 260/280° C. for the reference material Reference 1; 130/120° C. for the PLA/coPLA materials and 160/160° C. for the PP/PE material. The speed used was 200 pouches per minute. The sample composition was prepared by adding methyl salicylate flavour to pasteurized snus and blending it for 5 minutes, 98 rpm using a Varimixer (Bear RN20). The methyl salicylate concentration was set to 5% and the moisture content to 30%. The dry weight of the pouched product was 0.7 g and the final weight after post-moisturizing was 1 g. The final moisture content was adjusted to 51% to give a final methyl salicylate concentration of 3% of the pouch. Seal strengths were tested with the settings described in EP 3 192 380 A1, paragraph [0137].

Dimensions Pouched Product

For measuring of pouch length, width and height of a pouched product, a Cognex In-Sight system supported by 2 LED backlights and a double array bar light is used. For height, 3 evenly distributed points yield an average height. Hence, the dimensions are determined optically, without applying any external load.

BRIEF DESCRIPTION OF THE DRAWINGS

The present invention will hereinafter be further explained by means of non-limiting examples with reference to the appended figures wherein.

DETAILED DESCRIPTION

The invention will, in the following, be exemplified by embodiments. It should however be realized that the embodiments are included in order to explain principles of the invention and not to limit the scope of the invention, defined by the appended claims. Details from two or more of the embodiments may be combined with each other.

Figure 1:
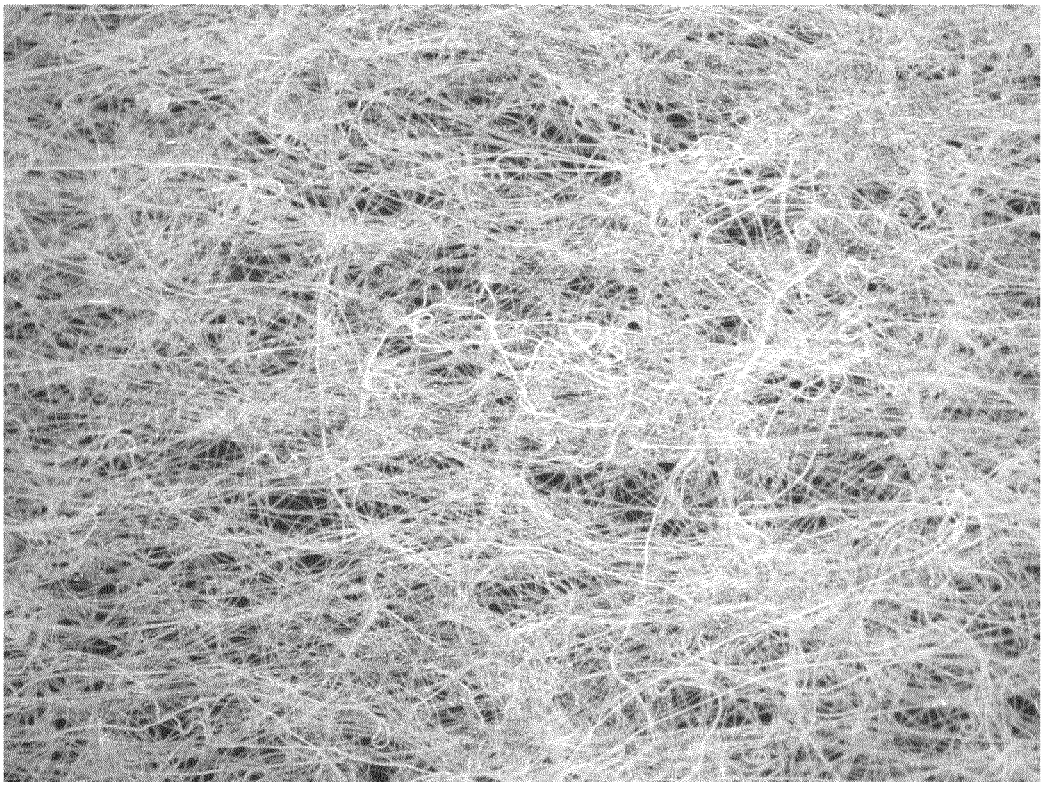
FIG. 1 illustrates a packaging material according to the invention.

FIG. 1 is a photo of a packaging material according to the invention. It comprises 20% fibres of the first type, which in this sample are regenerated cellulose fibres, namely lyocell. In the tables below the lyocell fibres are denoted by the brand name Tencel. This % number as well as the other %-numbers given herein are in given as weight percentages. The remaining 80% fibres are of the second type, which in this sample are PLA/coPLA fibres, wherein the PLA has a melting temperature of 164° C. and the coPLA has a melting temperature of 130° C. As can be seen in the photo, the fibres still maintain their shape and structure. There is no film formed. The individual fibres are easily seen.

Figure 2:
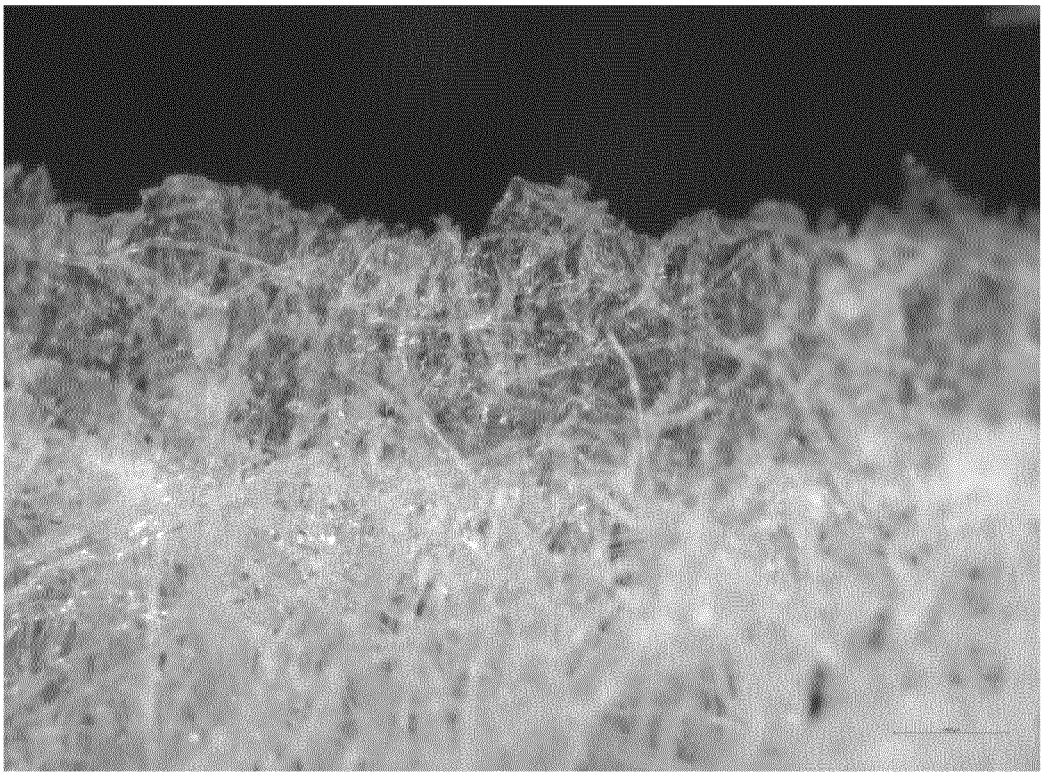
FIG. 2 illustrates a transverse seal.

FIG. 2 is a photo of a transverse seal of an oral pouched product comprising the packaging material according to the invention. The seal was made with ultrasonic welding. In the seal, the supplied energy was high enough to melt both the coPLA of the sheath and the PLA of the core. Hence, the fibres of the second type have melted so much in the seal that they form a kind of film.

In order to characterize the packaging materials according to the invention a number of measurements have been made comparing packaging materials according to the invention with commonly used packaging materials for oral pouched snuff products, denoted Reference 1, Reference 2 and Reference 3 below. Further, measurements have been made comparing oral pouched snuff products according to the invention with commercially available oral pouched snuff products. The pouched products comprise a portion of a smokeless tobacco composition or non-tobacco composition and a saliva-permeable pouch, which encloses the portion and comprises or consists of the packaging material as described herein.

The reference materials have in common that they comprise a chemical binder to bind the fibres of the reference material together. In the packaging material according to the invention, there is no such chemical binder.

Bending Stiffness

Bending stiffness was measured for different packaging materials according to the invention and compared to three commonly used packaging materials for oral pouched snuff products, see the three bottom lines of Table 1 below. See above for description of the method.

TABLE 1

| Material | Basis weight ($g/m^2$) | Bending stiffness_MD (mNcm) |
|---|---|---|
| 80% PLA/coPLA, 20% Tencel | 40 | 0.95 |
| 80% PLA/coPLA, 20% Tencel | 35 | 0.90 |
| 80% PLA/coPLA, 20% Tencel | 28 | 0.81 |
| 80% PP/PE, 20% Tencel | 25 | 0.71 |
| 80% PP/PE, 20% Tencel | 28 | 0.79 |
| 70% PP/PE, 30% Tencel | 26 | 0.73 |
| 70% PP/PE, 30% Tencel | 32 | 0.92 |
| Reference 1 | 29 | 2.10 |
| Reference 2 | 30 | 2.27 |
| Reference 3 | 36 | 4.60 |

As can be seen in Table 1, the packaging materials according to the invention have a bending stiffness in the machine direction within the range of 0.5-1.7 mNcm and also within the range of 0.6-1.4 mNcm. This is distinctly lower than those of the commonly used packaging materials for oral pouched snuff products. This contributes to making the pouched product comfortable when placed in the buccal cavity of the user.

Table 2 shows the values of Table 1 recalculated to a common grammage, in this case 29 g/m$^2$ being the basis weight of Reference 1, such that the bending stiffness values can be compared to each other at the common grammage. The recalculation was made by linear approximation between the values of Table 1. The packaging materials according to the invention have a bending stiffness in the machine direction when recalculated to 29 g/m$^2$ within the above-mentioned ranges.

TABLE 2

| Material | Basis weight (g/m$^2$) | Bending stiffness_MD (mNcm) |
|---|---|---|
| 80% PLA/coPLA, 20% Tencel | 29 | 0.82 |
| 80% PP/PE, 20% Tencel | 29 | 0.82 |
| 70% PP/PE, 30% Tencel | 29 | 0.83 |
| Reference 1 | 29 | 2.10 |
| Reference 2 | 30 | 2.27 |

Tensile Strength

Tensile strength was measured for wet and dry samples in the machine direction MD for four different packaging materials according to the invention, see Table 3 below, and compared to the same three references as in Table 1. See above for description of the method.

TABLE 3

| Material | Basis weight (g/m$^2$) | Tensile strength MD wet (N/mm) | Tensile strength MD (N/mm) | Tensile strength MD wet/MD |
|---|---|---|---|---|
| 70% PLA/coPLA, 30% Tencel | 36 | 0.31 | 0.34 | 0.9 |
| 80% PLA/coPLA, 20% Tencel | 35 | 0.54 | 0.46 | 1.2 |
| 70% PP/PE, 30% Tencel | 26 | 0.75 | 0.63 | 1.2 |
| 80% PP/PE, 20% Tencel | 29 | 1.25 | 1.01 | 1.2 |
| Reference 1 | 29 | 0.48 | 1.47 | 0.3 |
| Reference 2 | 30 | 0.7 | 1.94 | 0.4 |
| Reference 3 | 36 | 1.4 | 2.16 | 0.6 |

The ratio between wet and dry tensile strength for the packaging materials according to the invention, see column to the far right, is above 0.7, preferably above 0.8, more preferably above 0.9, most preferably above 1.0. When the packaging material is wet, the Tencel fibres may take up water, which may result in ratios over 1. These ratio values differ considerably from the references having ratios in the range of 0.3 to 0.6, i.e. the wet tensile strength is considerably lower than the dry tensile strength for the references.

Seal Strength—Lab Seal

Seal strength was measured for three different packaging materials according to the invention, see the three top lines of Table 4 below, and compared to a commonly used packaging material for oral pouched snuff products, see the bottom line. Samples were prepared in the way described in par. [0136] of EP 3 192 380 A1. The seal strengths were measured according to the CORESTA method described above. Measurements were performed both for seals made with ultrasonic welding and seals made with heat sealing. Further, measurements were made both in a dry state and a wet state.

TABLE 4

| | Seal strength (N/mm) | | | | Standard deviation | | | |
|---|---|---|---|---|---|---|---|---|
| | Ultrasonic | | Heat | | Ultrasonic | | Heat | |
| Material | Dry | Wet | Dry | Wet | Dry | Wet | Dry | Wet |
| 70% PLA/coPLA, 30% Tencel | 0.40 | 0.37 | 0.11 | 0.10 | 0.03 | 0.03 | 0.02 | 0.01 |
| 80% PLA/coPLA, 20% Tencel | 0.53 | 0.51 | 0.15 | 0.11 | 0.07 | 0.02 | 0.02 | 0.01 |
| 80% PP/PE, 20% Tencel | 0.45 | 0.51 | 0.41 | 0.44 | 0.05 | 0.02 | 0.11 | 0.13 |
| Reference 1 | 0.18 | 0.03 | 0.11 | 0.06 | 0.03 | 0.01 | 0.01 | 0.00 |

The packaging materials according to the invention has a dry seal strength, assuming the seal being made by ultrasonic welding, of at least 0.2 N/mm, preferably at least 0.25 N/mm, more preferably at least 0.3 N/mm, most preferably at least 0.4 N/mm, which is much higher than for the reference sample.

Moreover the seal strength for wet samples are much higher for the packaging material according to the invention than for the reference sample. Similar as for the dry seal strength, the packaging material according to the invention has a wet seal strength, assuming the seal being made by ultrasonic welding, of at least 0.2 N/mm, preferably at least 0.25 N/mm, more preferably at least 0.3 N/mm, most preferably at least 0.4 N/mm.

It may further be concluded that the wet seal strengths are at a similar level as the dry seal strengths for the packaging material according to the invention, which is valid for seals made both with ultrasonic welding and with heat sealing. Hence the ratio of wet to dry seal strength is above 0.7, preferably above 0.8, more preferably above 0.9, most preferably above 1.0. For the reference sample, the wet seal strengths are significantly lower than the dry seal strengths.

Seal Strength Over Time

Seal strength over time was measured for transverse seals of oral pouched snuff products made with three different packaging materials according to the invention, see the three top lines of Table 5 below, and compared to oral pouched snuff products made with a commonly used packaging material, see the bottom line below. Seal strengths were tested with the settings described in EP 3 192 380 A1, paragraph [0137]. The seals were made with ultrasonic welding. The ultrasonic welding was made with a method as disclosed in WO 2017/093486 A1. The samples were dry. The term "refridge" stands for a temperature of 4° C. RT refers to room temperature, i.e. 21° C. The abbreviation win the tables below means weeks.

TABLE 5

| Material | Seal strength day 0 (N/mm) | Standard deviation | Seal strength refridge 1 w (N/mm) | Standard deviation | Seal strength refridge 1 w + RT 3 w (N/mm) | Standard deviation |
|---|---|---|---|---|---|---|
| 70% PLA/coPLA, 30% Tencel | 0.39 | 0.05 | 0.39 | 0.06 | 0.37 | 0.05 |
| 80% PLA/coPLA, 20% Tencel | 0.59 | 0.11 | 0.55 | 0.10 | 0.59 | 0.06 |
| 80% PP/PE, 20% Tencel | 0.57 | 0.14 | 0.55 | 0.09 | 0.49 | 0.11 |
| Reference 1 | 0.18 | 0.03 | 0.23 | 0.03 | 0.21 | 0.02 |

The packaging materials according to the invention all have a higher seal strength than the reference. This is also the case after 1 week in the fridge and also after another 3 weeks in room temperature, i.e. the higher seal strength is preserved over time.

Seal Strength—Methyl Salicylate

Seal strength when exposed to methyl salicylate was measured for transverse seals of oral pouched snuff products made with three different packaging materials according to the invention, see the three top lines of Table 6 below, and compared to oral pouched snuff products made with a commonly used packaging material, see the bottom line below. The samples were made in a Merz apparatus. The seals were made with heat sealing. Seal strengths were tested with the settings described in EP 3 192 380 A1, paragraph [0137]. The samples were dry.

TABLE 6

| Material | Seal strength day 0 (N/mm) | Standard deviation | Seal strength refridge 1 w (N/mm) | Standard deviation | Seal strength refridge 1 w + RT 3 w (N/mm) | Standard deviation |
|---|---|---|---|---|---|---|
| 70% PLA/coPLA, 30% Tencel | 0.10 | 0.02 | 0.04 | 0.02 | 0.05 | 0.02 |
| 80% PLA/coPLA, 20% Tencel | 0.13 | 0.05 | 0.07 | 0.02 | 0.10 | 0.03 |
| 80% PP/PE, 20% Tencel | 0.34 | 0.06 | 0.48 | 0.13 | 0.43 | 0.18 |
| Reference 1 | 0.03 | 0.01 | 0.01 | 0.00 | 0.01 | 0.00 |

The seal strength when exposed to methyl salicylate is lower for all samples as compared to unexposed seals, cf. Table 5 above. The packaging materials according to the invention all have a higher seal strength when exposed to methyl salicylate than the reference. Especially the sample with PP/PE has a much better seal strength than the reference. This difference is preserved over time.

Pouch Dimensions

The smokeless non-tobacco composition was as described in WO 2012/134380, i.e. comprising a free nicotine salt, a pH adjusting agent and a filler being microcristalline cellulose. The weights of the pouched products, i.e. including the packaging material and the smokeless non-tobacco composition enclosed therein was selected to be 0.40 grams for the tested products. The lengths of the pouched products was selected to be 28 mm. The widths of the pouched products were selected to be 14 mm.

Reference samples are longer and less wide than the pouches according to the invention. Given this, the pouches according to the invention are still proportionally of greater height. Parameters width and length for the pouches according to the invention are within the product specification used for the reference product.

TABLE 7

| Material | Height (mm) | Std dev | Length (mm) | Standard deviation | Width (mm) | Std dev |
|---|---|---|---|---|---|---|
| 70% PLA/coPLA, 30% Tencel | 6.5 | 0.4 | 28.23 | 0.22 | 14.57 | 0.14 |
| 80% PLA/coPLA, 20% Tencel | 5.8 | 0.4 | 28.44 | 0.22 | 14.54 | 0.14 |
| 80% PP/PE, 20% Tencel | 6.4 | 0.5 | 28.01 | 0.16 | 14.01 | 0.16 |
| Reference 1 | 5.0 | 0.3 | 28.77 | 0.41 | 13.66 | 0.18 |

The invention claimed is:

1. A packaging material for use in an oral pouched snuff product in order to enclose a smokeless tobacco composition or non-tobacco composition, said packaging material over an entire area being a saliva-permeable nonwoven comprising carded fibres, characterized in that 5%-30% of said carded fibres are of a first type and 70%-95% are of a second type, said fibres of said first type being cellulose-based staple fibres, and said fibres of said second type being thermoplastic fibres, comprising a first component and a second component, said second component having a lower melting temperature than said first component, said packaging material over the entire area being bonded by means of at least partial melting and/or softening of said second component of said fibres of said second type, said packaging material over the entire area having a smooth-calendered surface, and said packaging material over the entire area not being bonded by calendering.

2. The packaging material according to claim 1, wherein 5%-15% of said carded fibres are of said first type and 85%-95% are of said second type.

3. The packaging material according to claim 1, wherein said packaging material consists of 5%-30% of said first type, 70%-95% of said fibres of said second type and, optionally, one or more further thermoplastic fibres.

4. The packaging material according to claim 1, wherein said at least partial melting and/or softening of said second component of said fibres of said second type is obtained by means of air-through bonding.

5. The packaging material according to claim 1, wherein said fibres of said first type are natural cellulose fibres or man-made cellulose-based fibres.

6. The packaging material according to claim 1, wherein said fibres of said first type has a length within the range of 30-80 mm.

7. The packaging material according to claim 1, wherein said fibres of said second type has a length within the range of 30-80 mm.

8. The packaging material according to claim 1, wherein said fibres of said first type has a linear density ≤3.3 dtex.

9. The packaging material according to claim 1, wherein said fibres of said second type has a linear density ≤4.4 dtex.

10. The packaging material according to claim 1, wherein said first component of said fibres of said second type has a melting point within the range of 140-180° C.

11. The packaging material according to claim 1, wherein said second component of said fibres of said second type has a melting point within the range of 110-150° C.

12. The packaging material according to claim 1, wherein said fibres of said second type are PLA/coPLA fibres, wherein said coPLA makes up a weight percentage within the range of 60%-90%.

13. The packaging material according claim 1, wherein said fibres of said second type are PP/PE fibres, wherein said PE makes up a weight percentage of the total weight within the range of 60%-90%.

14. The packaging material according to claim 1, said packaging material having a bending stiffness in the machine direction within the range of 0.5-1.7 mNcm, when measured by the EDANA standard method WSP 090.5R4 (12) with samples being conditioned for at least 4 hours in 21° C. and 50% RH.

15. The packaging material according to claim 1, said packaging material having an air permeability ≤75001/$m^2$/s when measured according to the test method WSP070.1.R3 (12) specified by EDANA.

16. The packaging material according to claim 1, said packaging material having a ratio between wet tensile strength and dry tensile strength, both taken in the machine direction of said packaging material, being above 0.7 when measured by the EDANA standard method WSP110.4(05).

17. The packaging material according to claim 1, said packaging material having a dry seal strength of at least 0.2 N/mm according to the method as defined herein, assuming said seal being made by ultrasonic welding.

18. The packaging material according to claim 1, said packaging material having a wet seal strength of at least 0.2 N/mm according to the method as defined herein, assuming said seal being made by ultrasonic welding.

19. The packaging material according to claim 1, having a ratio between wet and dry seal strength being above 0.7 according to the method as defined herein.

20. The packaging material according to claim 1, said packaging material having a dry seal strength when exposed to methyl salicylate of at least 0.05 N/mm after 1 week at 4° C.+3 weeks at room temperature according to the method as defined herein.

21. An oral pouched snuff product comprising a portion of a smokeless tobacco composition or non-tobacco composition and a saliva-permeable pouch, said pouch enclosing said portion, said pouch comprising or consisting of a packaging material as defined in claim 1, wherein said packaging material is sealed with at least one seal to enclose said portion, said seal being formed by means of at least said second component of said fibres of said second type being at least partially melted and/or softened in said seal.

22. The oral pouched snuff product according to claim 21, having an unloaded height of at least 5.5 mm, when measured optically, for products having a length of 28 mm, a width of 14 mm and a weight of 0.40 grams.

23. The packaging material according to claim 1, wherein the fibres of the second type are bi-component fibres.

* * * * *